United States Patent [19]

Konno et al.

[11] Patent Number: 4,911,114

[45] Date of Patent: Mar. 27, 1990

[54] DEVICE FOR SWITCHING VALVE OPERATION MODES IN AN INTERNAL COMBUSTION ENGINE

[75] Inventors: Tsuneo Konno, Saitama; Atsushi Ishida, Kanagawa, both of Japan

[73] Assignee: Honda Giken Kogyo Kabushiki Kaisha, Tokyo, Japan

[21] Appl. No.: 349,703

[22] Filed: May 10, 1989

[30] Foreign Application Priority Data

May 10, 1988 [JP] Japan ..... 63-112858

[51] Int. Cl.[4] ..... F01L 1/34

[52] U.S. Cl. ..... 123/90.16; 123/90.44

[58] Field of Search ..... 123/90.44, 90.15, 90.16, 123/90.17, 90.18, 198 F, 137

[56] References Cited

U.S. PATENT DOCUMENTS

| | | | |
|---|---|---|---|
| 4,535,732 | 8/1985 | Nakano et al. | 123/90.16 |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/90.16 |
| 4,576,128 | 3/1986 | Kenichi | 123/90.16 |
| 4,587,936 | 5/1986 | Matsuura et al. | 123/90.46 |
| 4,607,600 | 8/1986 | Yoshizaki | 123/90.16 |
| 4,612,884 | 9/1986 | Ajiki et al. | 123/90.16 |
| 4,656,977 | 4/1987 | Nagahiro et al. | 123/90.16 |
| 4,726,332 | 2/1988 | Nishimura et al. | 123/90.16 |
| 4,727,830 | 3/1988 | Nagahiro et al. | 123/90.16 |
| 4,727,831 | 3/1988 | Nagahiro et al. | 123/90.16 |
| 4,741,297 | 5/1988 | Nagahiro et al. | 123/90.16 |
| 4,768,467 | 9/1988 | Yamada et al. | 123/90.16 |
| 4,768,475 | 9/1988 | Ikemura | 123/90.16 |

*Primary Examiner*—Charles J. Myhre
*Assistant Examiner*—Weilun Lo
*Attorney, Agent, or Firm*—Lyon & Lyon

[57] ABSTRACT

A device for switching valve operation modes in an internal combustion engine with a rotatable camshaft having cams integral therewith, valves disposed in intake or exhaust ports of the combustion chamber and normally urged closed by a spring, and the valves being openable by the cams through a plurality of rocker arms disposed adjacent to each other for imparting the cam lifts to the valves. A coupling mechanism selectively connects and disconnects the rocker arms by means of pistons in aligned guide holes in the rocker arms movable between positions to either extend across the adjacent sides of the rocker arms or be aligned with such sides. A solenoid is provided in one rocker arm and surrounds a piston to selectively cause movement of that piston. Springs urge the pistons to the position controlled by the solenoid.

9 Claims, 3 Drawing Sheets

DEVICE FOR SWITCHING VALVE OPERATION MODES IN AN INTERNAL COMBUSTION ENGINE

The present invention relates to a switching device for varying, in a stepwise manner, the operation of an intake or exhaust valve of a combustion chamber depending on the rotational speed of an internal combustion engine.

Each of the combustion chambers of a four-cycle internal combustion engine has intake and exhaust valves for drawing an air-fuel mixture into and discharging burned gases from the combustion chamber at prescribed timing. These valves are normally urged to a closed position by valve springs disposed around the respective valve stems of the valves. The valves are forcibly opened against the bias force of the valve springs by cams integrally formed with camshafts which are rotated by the crankshaft of the engine through a belt and pulley mechanism.

Various arrangements have been proposed in which each cylinder of an engine has a plurality of intake or exhaust valves that are separately operated. During low-speed operation of the engine, one of the intake or exhaust valves is operated, and during high-speed operation of the engine, all the valves are operated, with the timing of operation of the valves being varied depending on the rotational speed of the engine. According to the proposed systems, the efficiency with which an air-fuel mixture is charged into the combustion chamber is increased over a wide range of driving conditions.

One conventional device for switching valve operation modes is disclosed in Japanese Laid-Open patent Publication No. 61-19911, for example. The disclosed switching device has a low-speed cam associated with one intake or exhaust valve and having a cam profile corresponding to a low-speed operation range of the engine, and a high-speed cam having a cam profile corresponding to a high-speed operation range of the engine, the cams being integrally formed on a camshaft which is rotatable about its own axis in synchronism with rotation of the engine. The switching device also includes a first rocker arm held in slidable contact with the low-speed cam and engageable with the intake or exhaust valve, a second rocker arm engageable with another intake or exhaust valve, and a third rocker arm held in slidable contact with the high-speed cam. The first through third rocker arms are mounted in mutually adjacent relation on a rocker shaft for relative angular displacement. A selective coupling means 5 disposed in the first through third rocker arms for switching between a mode in which the first through third rocker arms are coupled to each other for movement in unison and another mode in which the first through third rocker arms are disconnected for relative angular displacement therebetween. The selective coupling means comprises pistons extending slidably fitted in guide holes defined in the rocker arms, the pistons being movable under hydraulic pressure into positions across adjacent sides of the rocker arms for interconnecting the rocker arms The disclosed switching device has a hydraulic pressure source for generating the hydraulic pressure to move the pistons for interconnecting the rocker arms, the hydraulic pressure source comprising a pump for supplying engine lubricating oil. In order to increase the speed and reliability of responsive operation of the pistons of the switching device, a lubricating oil pump or accumulator having a relatively large capacity is required and the pipe system needed for supplying the hydraulic pressure is complicated, preventing the engine from being reduced in weight. This problem manifests itself and hence is not preferable in multicylinder engines. Moreover, since the valve operation mode switching devices associated with the respective cylinders are operated simultaneously under the hydraulic pressure supplied by a single hydraulic pressure supply passage, it is difficult to monitor the operation of the switching device for each of the cylinders.

In view of the aforesaid drawbacks of the conventional valve operation mode switching device, it is a major object of the present invention to provide a device for switching valve operation modes in an internal combustion engine, which device is simple in construction and can be monitored and controlled for operation with respect to each engine cylinder.

According to the present invention, the above object can be accomplished by a device for switching valve operation modes in an internal combustion engine that includes a camshaft having cams integral therewith and rotatable in synchronism with a crankshaft, a valve disposed in an intake or exhaust port of a combustion chamber and normally urged to be closed by spring means, the valve being openable by the cams, a plurality of transmitting members disposed adjacent to each other for imparting the lifts generated by the cams to the valve, and a selective coupling means for selectively connecting and disconnecting the transmitting member, wherein an actuator means for actuating the selective coupling means comprises solenoid means.

With the arrangement of this invention, the selective coupling means can be electrically actuated. Therefore, any complex hydraulic system which would increase the weight of the engine is not required. Since switching devices associated with respective engine cylinders can independently be controlled, the operation of the switching device associated with each engine cylinder can easily be monitored.

A preferred embodiment of the present invention will hereinafter be described in detail with reference to the accompanying drawings, wherein FIG. 1 is a fragmentary plan view of a valve operating mechanism having a valve operation mode switching device according to the present invention;

Figure 1:
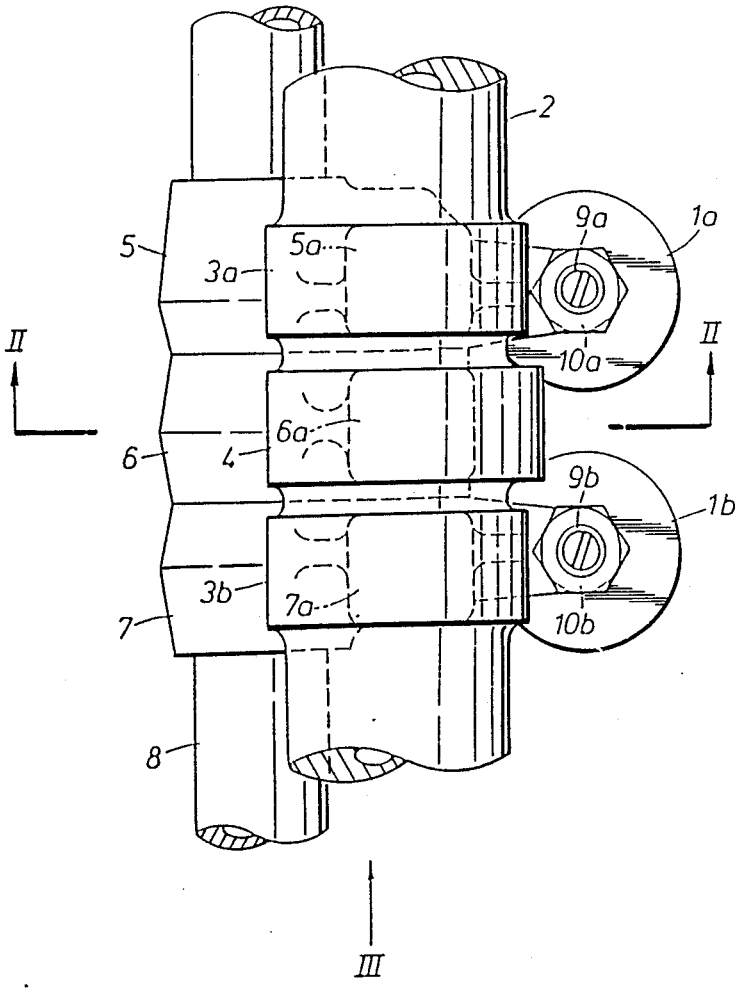

As shown in FIG. 1, a pair of intake valves 1*a*, 1*b* are mounted in the body of an internal combustion engine (not shown). The intake valves 1*a*, 1*b* are opened and closed selectively by a pair of low-speed cams 3*a*, 3*b* or a single high-speed cam 4 which are of a substantially egg-shaped cross section and which cams are integrally formed on a camshaft 2 rotatable by the crankshaft of the engine at a speed ratio of ½ with respect to the speed of rotation of the crankshaft, and by first, second, and third rocker arms 5, 6, 7 engaging the cams 3*a*, 4, 3*b*, respectively, that are angularly movable as valve-lift transmitting members. The internal combustion engine also has a pair of exhaust valves (not shown) which can be opened and closed in the same manner as the intake valves 1*a*, 1*b*.

The first through third rocker arms 5, 6, 7 are pivotally supported in mutually adjacent relation on a rocker shaft 8 extending below and parallel to the camshaft 2. The first and third rocker arms 5, 7 are basically of the same configuration. The first and third rocker arms 5, 7 have proximal ends supported on the rocker shaft 8 and free ends extending above the intake valves 1*a*, 1*b*, respectively. Tappet screws 9*a*, 9*b* are adjustably threaded through the free ends of the first and third rocker arms 5, 7 so as to be engageable with the upper ends of the intake valves 1*a*, 1*b*. The tappet screws 9*a*9*b* are prevented from loosening by respective locknuts 10*a*, 10*b*.

Figure 2:
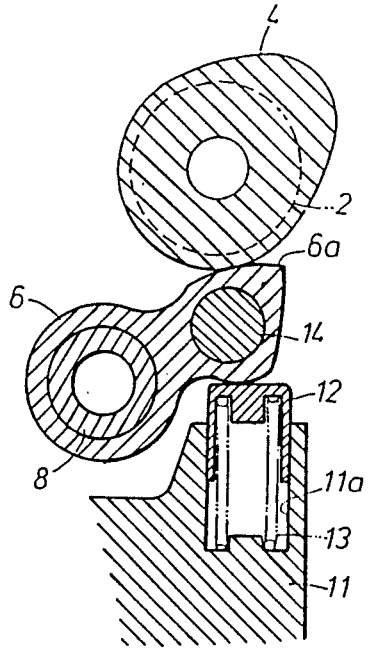
FIG. 2 is a cross-sectional elevation view taken along line II—II of FIG. 1.

The second rocker arm 6 is angularly movably supported on the rocker shaft 8 between the first and third rocker arms 5, 7. The second rocker arm 6 extends from the rocker shaft 8 a short distance toward and intermediate of the intake valves 1*a*, 1*b*. As better shown in FIG. 2, the second rocker arm 6 has on its upper surface a cam slipper 6*a* held in slidable contact with the high-speed cam 4, and also has its lower surface held in abutment against the upper end of a lifter 12 slidably fitted in a guide hole 11*a* defined in cylinder head 11. The lifter 12 is normally urged upwardly by a coil spring 13 interposed between the inner end of the lifter 12 and the bottom of the guide hole 11*a* to hold the cam slipper 6*a* of the second rocker arm 6 slidably against the high-speed cam 4 at all times.

Figure 3:
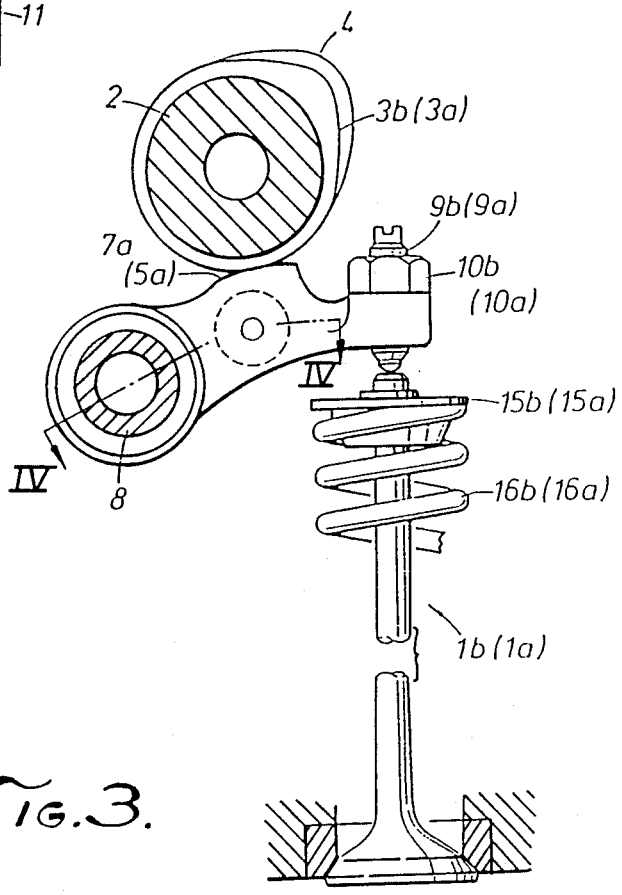
FIG. 3 is an elevation view of the valve operating mechanism as viewed in the direction of the arrow III in FIG. 1.

As described above, the camshaft 2 is rotatably supported above the engine body, and has integrally thereon the low-speed cams 3*a*, 3*b* aligned respectively with the first and third rocker arms 5, 7 and the high-speed cam 4 aligned with the second rocker arm 6. As shown in FIG. 3, the low-speed cams 3*a*, 3*b* each have a cam profile with a relatively small lift and a shape optimum for low-speed operation of the engine. The outer peripheral surfaces of the low-speed cams 3*a*, 3*b* are held in slidable contact with cam slippers 5*a*, 7*a* on the upper surfaces of the first and third rocker arms 5, 7, respectively. The high-speed cam 4 has a cam profile with a higher lift and a wider angular extent of a shape optimum for high-speed operation of the engine. The outer peripheral surface of the high-speed cam 4 is held in slidable contact with the cam slipper 6*a* of the second rocker arm 6. The lifter 12 is omitted from illustration in FIG. 3 for clarity.

Retainers 15*a*, 15*b* are mounted on the upper ends of the valve stems of the intake valves 1*a*, 1*b*, respectively. valve springs 16*a*, 16*b* are disposed around the valve stems of the intake valves 1*a*, 1*b* between the retainers 15*a*, 15*b* and the engine body for normally urging the valves 1*a*, 1*b* upwardly (as viewed in FIG. 3) in a direction to close these valves.

The first through third rocker arms 5, 6, 7 can be selectively switched between a mode in which they are pivotable in unison and another mode in which they are relatively displaceable, by a selective coupling mechanism 14 mounted in holes defined centrally through the rocker arms 5 through 7 parallel to the rocker shaft 8.

Figure 4:
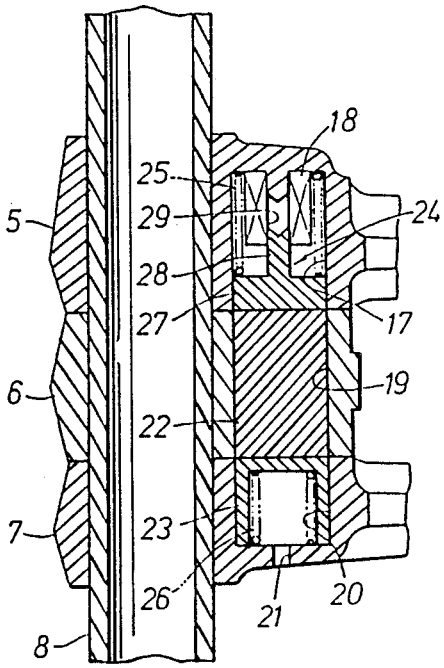
FIG. 4 is a cross-sectional plan view taken along line IV—IV of FIG. 3, showing a low-speed mode of operation.
Figure 5:
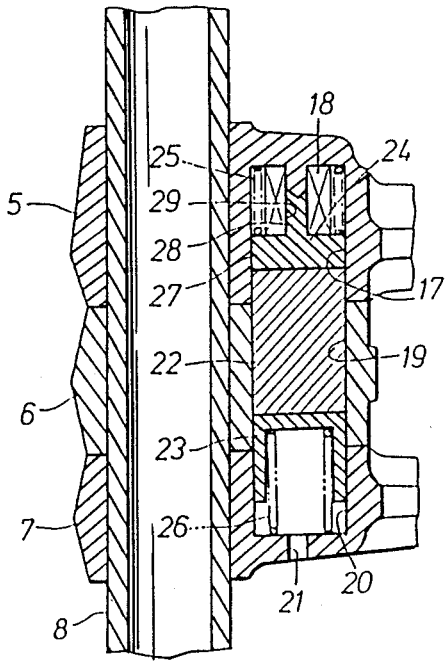
FIG. 5 is a view similar to FIG. 4, showing a high-speed operation mode.

The selective coupling mechanism 14 is illustrated in FIGS. 4 and 5 and will now be described. A first guide hole 17 is defined in first rocker arm 5 parallel to the rocker shaft 8 and opening toward the second rocker arm 6. An air core coil 18 is disposed coaxially in the first guide hole 17 at the bottom thereof. The second rocker arm 6 has a second guide hole 19 defined therethrough between the opposite sides thereof in alignment with the first guide hole 17 in the first rocker arm 5. The third rocker arm 7 has a third guide hole 20 in alignment with the second guide hole 19. The second rocker arm 7 also has a smaller-diameter through hole 21 defined in the bottom of the third guide hole 20 coaxially therewith.

The first, second, and third guide holes 17, 19, 20 house therein a first piston 22 movable between a position in which it connects the first and second rocker arms 5, 6 (FIG. 5) and a position in which it disconnects the first and second arms 5, 6 (FIG. 6), a second piston 23 movable between a position in which it connects the second and third rocker arms 6, 7 and a position in which it disconnects the second and third rocker arms 6, 7, a stopper 24 for limiting the distance over which the pistons 22, 23 are movable in the upward direction, a first coil spring 25 for normally urging the pistons 22, 23 in a direction to disconnect the rocker arms 5, 6, 7, and a second coil spring 26 having a spring constant smaller than that of the first coil spring 25 for normally urging the pistons 22, 23 in a direction to connect the rocker arms 5, 6, 7.

The first piston 22 has an axial dimension which is substantially equal to the entire length of the second guide hole 19, and a diameter that can be slidably fitted into the first and second guide holes 17, 19.

The second piston 23 is sized to slidably fit in the second and third guide holes 19, 20. The second piston 23 has an axial dimension such that when one end of the second piston 23 abuts against the bottom of the third guide hole 20, the other end of the second piston 23 is aligned with and does not project beyond the side of the third rocker arm 7 which faces the second rocker arm 6. The second piston 23 is in the form of a bottomed cylinder with the second coil spring 26 disposed under compression between the inner end of the second piston 23 and the bottom of the third guide hole 20.

The stopper 24 has on one end thereof a disc 27 slidably fitted in the first guide hole 17 and on the other end thereof a guide rod 29 extending into an air core or hole 28 in the coil 18. The first coil spring 25 is disposed under compression around the coil 18 between the disc 27 of the stopper 24 and the bottom of the first guide hole 17.

Operation of the valve operation mode switching device including the selective coupling mechanism 14 will be described below with reference to FIGS. 4 and 5.

While the engine is operating in low- and medium-speed ranges, the coil 18 remains de-energized. Since the spring constant of the first coil spring 25 is higher than that of the second coil spring 26, the pistons 22, 23 are positioned within the guide holes 19, 20, respectively, under the bias force of the first coil spring 25, as shown in FIG. 4. Therefore, the rocker arms 5, 6, 7 are angularly displaceable relatively to each other.

When the rocker arms 5, 6, 7 are disconnected from each other by the selective coupling mechanism 14, the first and third rocker arms 5, 7 are in sliding contact with the low-speed cams 3*a*, 3*b* are pivoted thereby in response to rotation of the camshaft 2. The intake valves 1*a*, 1*b* are opened with delayed timing closed with advanced timing, and opened and closed with across a smaller lift. At this time, the second rocker arm 6 is pivoted by the sliding contact with the high-speed cam 4, but such pivotal movement of the second rocker arm 6 does not affect the operation of the intake valves 1*a*, 1*b* at all.

While the engine is operating in a high-speed range, the coil 18 is energized in timed relation to a detected signal indicating a crank angle or the like. As shown in FIG. 5, the stopper 24 is magnetically attracted to the coil 18 against the bias of the first coil spring 25, whereupon the first and second pistons 22, 23 are moved toward the first rocker arm 5 under the bias force of the second coil spring 26. As a result, the first and second rocker arms 5, 6 are interconnected by the first piston 22, and the second and third rocker arms 6, 7 are interconnected by the second piston 23.

With the first, second, and third rocker arms 5, 6, 7 being thus coupled to each other by the selective coupling mechanism 14 and because the second rocker arm 6 is held in sliding contact with the high-speed cam 4 which pivots to the largest extent, the first and third rocker arms 5, 7 are angularly pivoted with the second rocker arm 6. Therefore, the intake valves 1*a*, 1*b* are opened with advanced timing, closed with delayed timing, and opened and closed with a larger lift, according to the cam profile of the high-speed cam 4.

In the illustrated embodiment, the three rocker arms are employed to switch the timing of operation of the two valves together. However, the principles of the present invention are also applicable to other valve operation mode switching devices such as one in which two rocker arms are operated by a single cam and one of the valves is disabled at a predetermined rotational speed.

With the present invention, as described above, no hydraulic system is employed for operating the selective coupling mechanism, and therefore the actuator of the valve operation mode switching device is simple in structure. The switching devices associated with respective cylinders of an engine can independently be operated to switch the operation modes of valves of the cylinders. The switching device of the present invention can switch the valve operation modes in precise synchronism with given cam lift timing. The positions of the pistons of the selective coupling asssociated with each of the cylinders can easily be detected by an electric current supplied to energize the coil in the selective coupling. The valve operation mode switching device of the invention is effective in preventing the internal combustion engine from being increased in weight.

The claimed invention is:

1. A device for switching valve operation modes in an internal combustion engine including a camshaft having cams integral therewith and rotatable in synchronism with a crankshaft, a valve disposed in an intake or exhaust port of a combustion chamber and normally urged to be closed by spring means, said valve being openable by said cams, a plurality of transmitting members disposed adjacent to each other for imparting lifts of said cams to said valve, and a selective coupling means for selectively connecting and disconnecting said transmitting members, comprising, actuator means for actuating said selective coupling means, said actuator means comprising solenoid means, wherein said solenoid means includes a coil mounted in one of said transmitting means.

2. A device according to claim 1, wherein said selective coupling means comprises, guide holes in said transmitting members in communication with each other, pistons slidably fitted in guide holes and being displaceable into positions extending across adjacent sides of said transmitting members for selectively connecting said transmitting members, first spring means for urging said pistons in a direction opposite to the direction in which the pistons are attracted by said solenoid means, and second spring means for urging said pistons in the same direction as the direction in which the pistons are attracted by said solenoid means.

3. A device according to claim 2, wherein said first spring means has a larger spring constant than said second spring.

4. A device according to claim 2, wherein said first spring has a biasing force sufficient to maintain said pistons in positions in the guide holes of respective transmitting members for disconnecting said transmitting members when said solenoid means is deactivated.

5. In a device for switching valve operation modes in an internal combustion engine having a camshaft with at least two different cams, a valve disposed in an intake or exhaust port of a combustion chamber, a plurality of valve-lift transmitting members disposed adjacent to each other for imparting lifts produced by said cams to said valve for opening said valve, and a selective coupling means provided in said valve-lift transmitting means for selectively connecting and disconnecting said valve-lift transmitting means, an improvement comprising:

said selective coupling means having an actuator means comprising solenoid means for selectively actuating said coupling means for connecting and disconnecting said valve-lift transmitting means, wherein said solenoid means includes a coil mounted in one of said transmitting means.

6. A device according to claim 5, wherein sad selective coupling means comprises: guide holes in said valve-lift transmitting members in alignment with each other, pistons slidably fitted in said guide holes, said pistons being displaceable into positions extending across adjacent sides of said valve-lift transmitting members for causing said connecting thereof, and said solenoid means operatively associated with one of said pistons for causing displacement of said pistons.

7. A device according to claim 6, wherein said coupling means includes a first spring means for urging said pistons in a direction opposite to the direction in which the pistons are attracted by said solenoid means, and second spring means for urging said pistons in the same direction as the direction in which the pistons are attracted by said solenoid means.

8. A device according to claim 7, wherein said first spring means has a larger spring constant than said second spring.

9. A device according to claim 7, wherein said first spring has a biasing force sufficient to maintain said pistons in positions in the guide holes of respective transmitting members for disconnecting said transmitting members when said solenoid means is deactivated.

* * * * *